US009763009B2

(12) United States Patent
Bartylla et al.

(10) Patent No.: US 9,763,009 B2
(45) Date of Patent: Sep. 12, 2017

(54) ELECTROACOUSTIC TRANSDUCER

(71) Applicant: Robert Bosch GmbH, Stuttgart (DE)

(72) Inventors: David Bartylla, Leonberg (DE); Andre Gerlach, Leonberg-Hoefingen (DE)

(73) Assignee: ROBERT BOSCH GMBH, Stuttgart (DE)

( * ) Notice: Subject to any disclaimer, the term of this patent is extended or adjusted under 35 U.S.C. 154(b) by 0 days.

(21) Appl. No.: 14/900,447

(22) PCT Filed: May 26, 2014

(86) PCT No.: PCT/EP2014/060763

§ 371 (c)(1),
(2) Date: Dec. 21, 2015

(87) PCT Pub. No.: WO2014/202335

PCT Pub. Date: Dec. 24, 2014

(65) Prior Publication Data

US 2016/0142822 A1 May 19, 2016

(30) Foreign Application Priority Data

Jun. 20, 2013 (DE) ..... 10 2013 211 630

(51) Int. Cl.
*H04R 25/00* (2006.01)
*H04R 7/04* (2006.01)
(Continued)

(52) U.S. Cl.
CPC ..... *H04R 7/045* (2013.01); *B06B 1/0644* (2013.01); *B06B 3/00* (2013.01); *G10K 11/004* (2013.01); *H04R 1/26* (2013.01); *H04R 17/00* (2013.01)

(58) Field of Classification Search
CPC ..... H04R 7/045; H04R 1/26; H04R 17/00; B06B 1/0644; B06B 3/00; G10K 11/004
(Continued)

(56) References Cited

U.S. PATENT DOCUMENTS 4,504,703 A * 3/1985 Schneiter ..... H04R 1/22 181/163
4,768,615 A * 9/1988 Steinebrunner ..... G10K 13/00 181/157
(Continued)

FOREIGN PATENT DOCUMENTS

DE 10114672 9/2002
DE 102009040264 3/2011
JP 2002065688 3/2002

OTHER PUBLICATIONS

International Search Report for PCT/EP2014/060763, issued on Nov. 26, 2014.

*Primary Examiner* — Duc Nguyen
*Assistant Examiner* — Sean H Nguyen
(74) *Attorney, Agent, or Firm* — Norton Rose Fulbright US LLP; Gerard Messina

(57) ABSTRACT

An electroacoustic transducer is provided that combines the properties and advantages of the known concepts of the thickness mode transducer and of the bending transducer with each other. For this purpose, an electroacoustic transducer is provided, which includes a housing and an oscillating structure. The oscillating structure is formed by at least one piezoelectric element, a diaphragm, and an acoustic transmitter. It is provided that the diaphragm is designed as a bending transducer, and the acoustic transmitter is designed as a thickness mode transducer.

19 Claims, 3 Drawing Sheets

(51) Int. Cl.

| | |
|---|---|
| ***B06B 1/06*** | (2006.01) |
| ***B06B 3/00*** | (2006.01) |
| ***G10K 11/00*** | (2006.01) |
| ***H04R 1/26*** | (2006.01) |
| ***H04R 17/00*** | (2006.01) |

(58) Field of Classification Search
USPC ..... 381/190
See application file for complete search history.

(56) References Cited

U.S. PATENT DOCUMENTS

| | | | | |
|---|---|---|---|---|
| 5,452,267 | A | 9/1995 | Spevak | |
| 8,320,218 | B2 | 11/2012 | Massa | |
| 2007/0035208 | A1 | 2/2007 | Tessien et al. | |
| 2007/0120442 | A1 | 5/2007 | Piotr et al. | |
| 2007/0165872 | A1* | 7/2007 | Bridger ..... | A61B 7/04 381/67 |
| 2010/0020646 | A1 | 1/2010 | Massa | |
| 2010/0208553 | A1 | 8/2010 | Massa | |

* cited by examiner

ELECTROACOUSTIC TRANSDUCER

FIELD OF THE INVENTION

The present invention is directed to an electroacoustic transducer.

BACKGROUND INFORMATION

U.S. Published Patent Application No. 2010/0020646 describes an ultrasonic transducer, which provides a transmission path between an oscillating surface (piezoelectric ceramic) of the transducer material and a medium in which the oscillations are transmitted, a so-called λ/2 resonator (thickness mode transducer) including an essentially rod-shaped transmission element, which is variable in shape, length and cross section, being mentioned. However, the preferred length of the transmission element is in particular λ/4. The design of the transmission element depends on the acoustic radiation pattern to be achieved at the resonance frequency. In one specific embodiment, the transmission element is integrated into a protective housing of the sound transducer.

Proceeding from the piezoelectric ultrasonic transducer described in U.S. Published Patent Application No. 2010/0020646, which includes a forward and a rear transmission element, U.S. Pat. No. 8,320,218 describes an ultrasonic transducer which is hidden, for example in a bumper, in conjunction with parking systems. The forward, rod-shaped transmission element is designed as a composite element, further including a smooth plate, for example a portion of the material surface (bumper, vehicle door), on which the ultrasonic transducer is installed in a hidden manner. This smooth area is part of the resonator structure and is excited by the electroacoustic transducer.

Furthermore, means are described for a hidden and protected installation of the ultrasonic transducer.

German Published Patent Application No. 10 2009 040 264 describes an elongated ultrasonic transducer, which is coupled to a component of a vehicle in such a way that a longitudinal axis of the ultrasonic transducer is essentially coupled perpendicularly to an area of the component, local thickness mode oscillations of the component being caused in an active ultrasonic transducer to generate ultrasonic waves. In this way, an improved radiation pattern of the ultrasonic lobe may be achieved and a hidden installation may be implemented.

German Published Patent Application No. 10 2009 040 264 relates to an elongated ultrasonic transducer having a larger length dimension than the width dimension, which may be composed of multiple disks, designed as a monolithic piezoceramic or as a rod-shaped piezo element.

SUMMARY

The present invention provides for a novel composition for an electroacoustic transducer, which is suitable in particular for the hidden installation, for example into lining elements of vehicles.

The present invention is based on the idea of creating an electroacoustic transducer which combines the properties and advantages of the known concepts of the thickness mode transducer and of the bending transducer with each other. In this way, for example, the electrical contacting of the piezoelectric element in the case of a bending transducer is easily accessible from the outside. The piezoceramic material moreover need not be preloaded compared to a conventional (λ/2) thickness mode transducer. This is advantageous since piezoceramics are typically only able to withstand tensile loads to a moderate degree without becoming damaged. In addition, it is easily possible to dampen the oscillation from the outside in a composition according to the present invention, for example with the aid of silicone foam. Geometry and material parameters of both the thickness mode transducer and of the bending transducer are available for setting the resonance frequency (working frequency). By suitably selecting the parameters, a design may be selected which is robust, with respect to tolerances, for example, as a function of the desired application.

For this purpose, an electroacoustic transducer is provided according to the present invention, which includes a housing and an oscillating structure. The oscillating structure is formed by at least one piezoelectric element, a diaphragm, and an acoustic transmitter. In this context, a diaphragm shall be understood to mean in particular a plate which, even though it has a low thickness compared to its surface area and is therefore able to carry out flexural oscillations in a direction perpendicular to its surface, still has a certain degree of flexural stiffness.

According to the present invention, the diaphragm is connected to the piezoelectric element, so that mechanical oscillations may be transmitted from the diaphragm to the piezoelectric element and generate corresponding electrical signals according to the known principle of an electroacoustic transducer. Mechanical oscillations, which are transmitted to the diaphragm, are generated by applying corresponding electrical signals to the piezoelectric element. Electrical connecting means for contacting electrodes of the piezoelectric element are provided for this purpose.

The acoustic transmitter transmits oscillations to or from the diaphragm. For this purpose, the acoustic transmitter includes a first surface and a second surface in parallel to the first surface, the first surface of the acoustic transmitter being coupled to the diaphragm, and the second surface of the acoustic transmitter being suitable for emitting and/or receiving sound waves. Coupling shall be understood to mean a mechanical connection here, which allows sound waves to be transmitted.

According to the present invention, it is provided that the diaphragm is designed as a bending transducer, and the acoustic transmitter is designed as a thickness mode transducer. The acoustic transmitter is in particular designed as a so-called λ/2 thickness mode transducer, λ corresponding to the wavelength of a thickness mode oscillation of the oscillating structure and being dependent on the sound velocity of the material and the frequency of the oscillation. The transmitter is resonant when the wavelength generated by the excitation is a multiple of λ/2.

Sound waves incident upon the second surface of the acoustic transmitter excite the acoustic transmitter in order to carry out thickness mode oscillations, in other words, periodic changes in length in the longitudinal direction. Since the acoustic transmitter is connected to the diaphragm, these thickness mode oscillations in turn cause flexural oscillations of the diaphragm. The piezoelectric element, which is connected to the diaphragm, converts these flexural oscillations into electrical signals. Corresponding electrical signals are applied to the piezoelectric element for generating sound waves. As a result, the diaphragm is excited to carry out flexural oscillations. These generate corresponding thickness mode oscillations of the acoustic transmitter, and sound waves are radiated from the second surface of the acoustic transmitter.

The electroacoustic transducer according to the present invention may thus be used as a sensor in a surroundings detection system as it is used in passenger cars or in robotics. Ultrasonic signals may be emitted for detecting the surroundings and are reflected by objects in the surrounding area. The reflected echo signals may be received by the sensor and further processed by a corresponding electronics unit in the known manner. In this way, it is possible to identify obstacles and avoid collisions, for example.

The subclaims show preferred refinements of the present invention.

In one preferred embodiment of the present invention, the first surface of the acoustic transmitter is coupled to a first surface of the diaphragm. A second surface of the diaphragm is connected to the piezoelectric element, for example by adhesive bonding of the piezoelectric element. Such a composition may be implemented by connecting the diaphragm on a first surface to the first surface of the acoustic transmitter in such a way that a preferably low-loss transmission of the acoustic oscillations is ensured. This may be achieved, for example, with the aid of bonding using a suitable adhesive or welding or screwing. Alternatively, the diaphragm may also be designed in one piece with the acoustic transmitter or a subcomponent of the acoustic transmitter.

The piezoelectric element is preferably bonded to the diaphragm across the full surface. The shape of the piezoelectric element may be circular, elliptic, angular or arbitrary. Furthermore, an embodiment having an annular design of the piezoelectric element is possible.

In one particularly preferred embodiment of an electroacoustic transducer according to the present invention, the acoustic transmitter includes an essentially rod-shaped element and a plate. Rod-shaped shall be understood to mean that the element has a solid design and a main extension in the longitudinal direction. The end faces may be arbitrarily shaped, such as circular, oval or rectangular. It is also conceivable to design the end faces in a differently sized and/or differently shaped manner. One end face of the rod-shaped element is connected to the diaphragm. The other end face is connected to the plate, the diaphragm and/or the plate also being designable in one piece with the rod-shaped element. The surface of the plate facing away from the rod-shaped element thus forms the second surface of the acoustic transmitter, which is suitable for emitting and/or for receiving sound waves. The ratio of the shape and surface area between the plate and the end faces of the rod-shaped element and the thickness of the plate determine the radiation pattern of the electroacoustic transducer. By appropriately selecting these parameters, a desired radiation pattern of the electroacoustic transducer in relation to the angle dependence of the signal strength and the resonance frequencies may be set. Customary frequencies are in the range from 30 kHz to 150 kHz.

The plate may be designed as part of a lining element of a vehicle, in particular of a bumper, for example. The plate may be designed in one piece with the lining element or as a separate part. It is advantageous for the acoustic radiation properties if the plate has a lower thickness than the surrounding lining element. For this reason, a lining element may have a reduced material thickness, for example in the area by which the plate is formed. Thicknesses of 0.1 mm to 10 mm are advantageous, or in more general terms, a ratio of a diameter of the plate to the thickness of the plate of approximately 10/1 is advantageous.

The housing of the electroacoustic transducer according to the present invention is joined to an inside surface of the lining element in such a way that the electroacoustic transducer is not visible from the outside. This results in the advantage that the transducer may be situated protected from environmental influences, such as dirt or wetness. Moreover, this results in design advantages. The housing may also be designed in one piece with the lining element for this purpose.

To attach the oscillating structure of the electroacoustic transducer to the housing, the diaphragm may preferably be attached to the housing with the aid of a bearing structure. For this purpose, the housing may have a peripheral area having a reduced wall thickness, for example, on which the diaphragm is attached in its edge area, for example with the aid of adhesive bonding or with the aid of clamping. Alternatively, the mounting may also be designed to be movable, for example in that the contact surface between the diaphragm and the housing is designed to be small compared to the total surface area of the diaphragm, and thus flexible.

As an alternative or in addition, the rod-shaped element may be held on the housing with the aid of a bearing structure. The bearing structure is preferably situated in particular at a height of the rod-shaped element which corresponds to a node of a resonance oscillation of the oscillating structure. The bearing structure is thus situated in a position in which the rod-shaped element experiences only a small change in length, or none at all, during an excited thickness mode oscillation. The bearing structure thus undergoes only minor mechanical loading.

In one specific embodiment of the present invention, the rod-shaped element has a decreasing cross-sectional area in the direction of the first surface connected to the diaphragm and/or in the direction of the end face connected to the plate. The rod-shaped element is thus tapered in the direction of the diaphragm and/or in the direction of the plate. The resulting reduced connecting surface between the rod-shaped element and the diaphragm or the plate causes the oscillating properties, in particular the bending, of the diaphragm and/or of the plate to be impeded only slightly. This results in an improved sensitivity for incident sound waves and a higher signal strength of the emitted acoustic signal.

When joining the rod-shaped element and the plate, it is important to adhere to an exact relative positioning of the rod-shaped element and the plate in order to achieve a desired radiation pattern of the electroacoustic transducer. It is therefore provided according to one further preferred embodiment of the present invention that the rod-shaped element has at least one mounting aid element on its end face facing the plate. This element may be designed as a recess or an elevation. It is also possible to provide combinations of elevations and recesses. On its surface facing the end face of the rod-shaped element, the plate has at least one complementary mounting aid element. As a result of the engagement of the mounting aid elements on the end face of the rod-shaped element and the plate, an intended, in particular centrical, positioning of the rod-shaped element and of the plate is achieved. In specific embodiments in which the angular alignment between the plate and the rod-shaped element is important, for example to achieve a certain radiation pattern, the correct angular alignment may be ensured via a corresponding, for example not rotation-symmetrical, arrangement of mounting aid elements.

DETAILED DESCRIPTION

Figure 1:
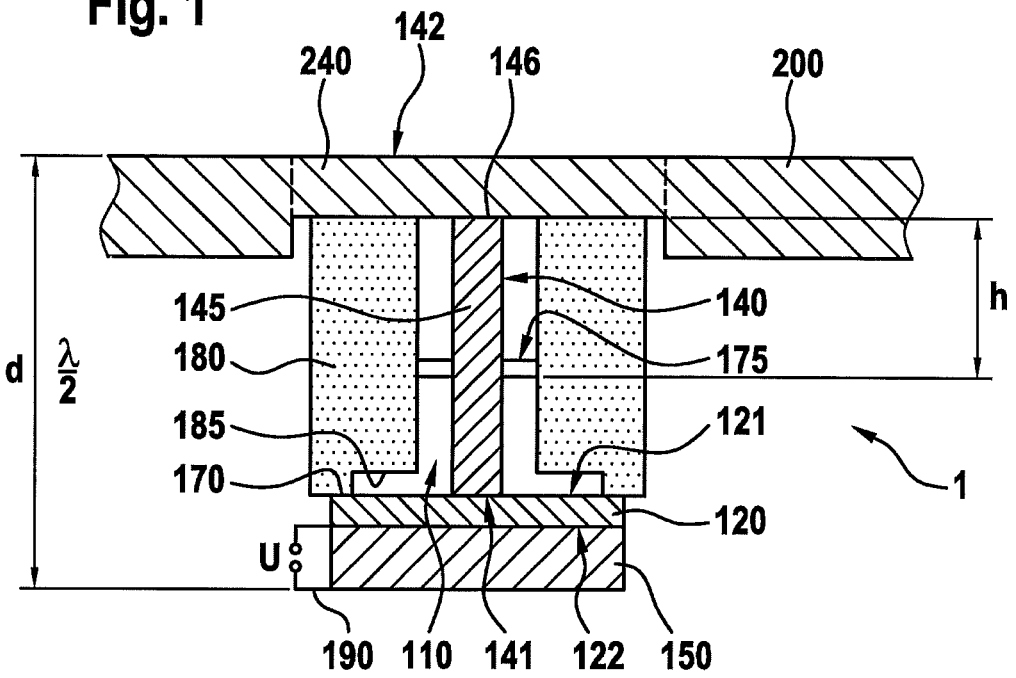
FIG. 1 shows an electroacoustic transducer according to a first embodiment of the present invention.

FIG. 1 shows a schematic longitudinal section through an electroacoustic transducer 1 according to a first embodiment of the present invention. Electroacoustic transducer 1 includes a housing 180 and an oscillating structure 110. Oscillating structure 110 includes a piezoelectric element 150, which in this example is designed as a piezoceramic disk. The piezoceramic disk is glued to bottom side 122 of diaphragm 120. The piezoceramic disk essentially has the same surface shape and size as diaphragm 120 and ends flush with diaphragm 120.

When a corresponding voltage signal U is applied to piezoceramic disk 150, the same may cause diaphragm 120 to oscillate. Electrical connecting means 190 are provided for this purpose, which are contacted with electrodes of piezoelectric element 150 and are shown only schematically here.

A rod-shaped element 145 is attached to top side 121 of the diaphragm. A first surface 141 of the rod-shaped element is connected to the diaphragm. The attachment may be carried out with the aid of screwing and/or welding and/or adhesive bonding, for example. Rod-shaped element 145 is attached, in particular bonded, with its second surface (end face) 146 to a plate 240. Plate 240 is connected in one piece to a lining element 200, which in this example is the bumper or a trim of a motor vehicle.

Housing 180 is attached to the inner side of lining element 200, for example with the aid of adhesive bonding, whereby the electroacoustic transducer is not visible from the outside. Housing 180 is essentially cylindrical in this example and is made of a metal, such as aluminum. It has a high impedance (it is stiff and/or heavy) in parallel to the oscillating direction of rod-shaped element 145, so that the introduction of oscillations into housing 180 remains preferably low. Diaphragm 120 is mounted in an edge area 185 of housing 180. Housing 180 has a lower wall thickness in this edge area 185. Mounting 170 may be designed to be fixed, for example with the aid of clamping or adhesive bonding. Alternatively, mounting 170 may have a certain mobility, which is achieved in that the contact surface between diaphragm 120 and housing 180 is designed to be small, and thus flexible.

Outwardly directed surface 142 of plate 240 is suitable for emitting and/or receiving sound waves. Together, plate 240 and rod-shaped element 145 form acoustic transmitter 140 according to the present invention, which is excitable by flexural oscillations of diaphragm 120 to carry out thickness mode oscillations. In the reception case, this principle is exactly reversed. Sound waves impinge on surface 142 and excite plate 240. The plate excites rod-shaped element 145, which in turn excites diaphragm 120 to carry out flexural oscillations. Since piezoelectric element 150 is glued to diaphragm 120, voltage signals are generated at piezoelectric element 150, which may be tapped by electrical connecting means 190 and further processed for evaluation. In general, oscillating structure 110 will oscillate at a certain resonance frequency. Longitudinal extension d of oscillating structure 110 corresponds to half a wavelength ($\lambda/2$) of the resonance oscillation. Longitudinal extension d is essentially determined by the length of rod-shaped element 145, which is why the same is also referred to as $\lambda/2$ thickness mode transducer.

Figure 4:
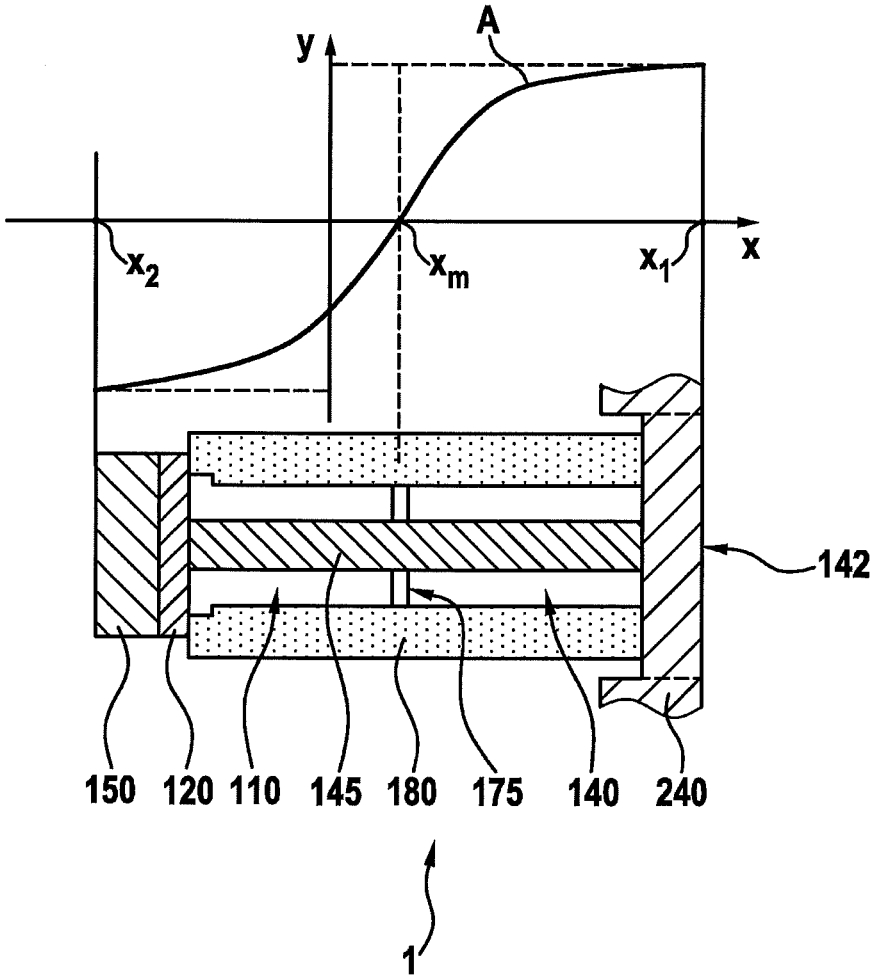
FIG. 4 shows the electroacoustic transducer according to the first embodiment of the present invention, together with a diagram of the deflection in the thickness direction of the acoustic transmitter.

FIG. 4 schematically illustrates deflection A of the thickness mode oscillation in a diagram. The x axis corresponds to the longitudinal direction, and the y axis corresponds to the deflection of the oscillating structure. The deflection corresponds to half the wavelength of the oscillation. The maximum deflections occur at the corresponding ends $x_1$, $x_2$ of oscillating structure 110. In the center $x_m$, the deflection is essentially zero, corresponding to a node.

Metals, such as aluminum or stainless steel, may be used to manufacture diaphragm 120 and rod-shaped element 145. It is also possible to use plastic materials, which ideally have no glass transition temperature in the temperature range of −40° C. to +85° C. A combination of different materials is also possible. The length of the rod-shaped element is to be selected as a function of the selection of the transmitting frequency and the material used for rod-shaped element 145 and the propagation velocity of the sound waves associated therewith. To avoid oblique positions of rod-shaped element 145, in particular when rod-shaped element 145 is very long compared to the dimensions of plate 240 or diaphragm 120, rod-shaped element 145 may be fixed to housing 180 with the aid of a further bearing structure 175. Bearing structure 175 may preferably be situated at half the height h of rod-shaped element 145. This centrical position of bearing structure 175 is selected since the amplitude of the thickness mode oscillations is minimal there. The position corresponds to the node at position $x_m$ in the illustration according to FIG. 4.

In the embodiment of the present invention shown in FIG. 1, diaphragm 120, rod-shaped element 145, housing 180, and plate 240 are designed as separate components. As an alternative, diaphragm 120 and rod-shaped element 145 may also be designed in one piece.

As an alternative, diaphragm 120 may be implemented in one piece with housing 180 and/or housing 180 may be formed in one piece with plate 240 or lining element 200.

To protect electroacoustic transducer 1 even better with respect to the outside from environmental influences, such as moisture or dust, still another cover (not shown) may be provided.

Figure 2:
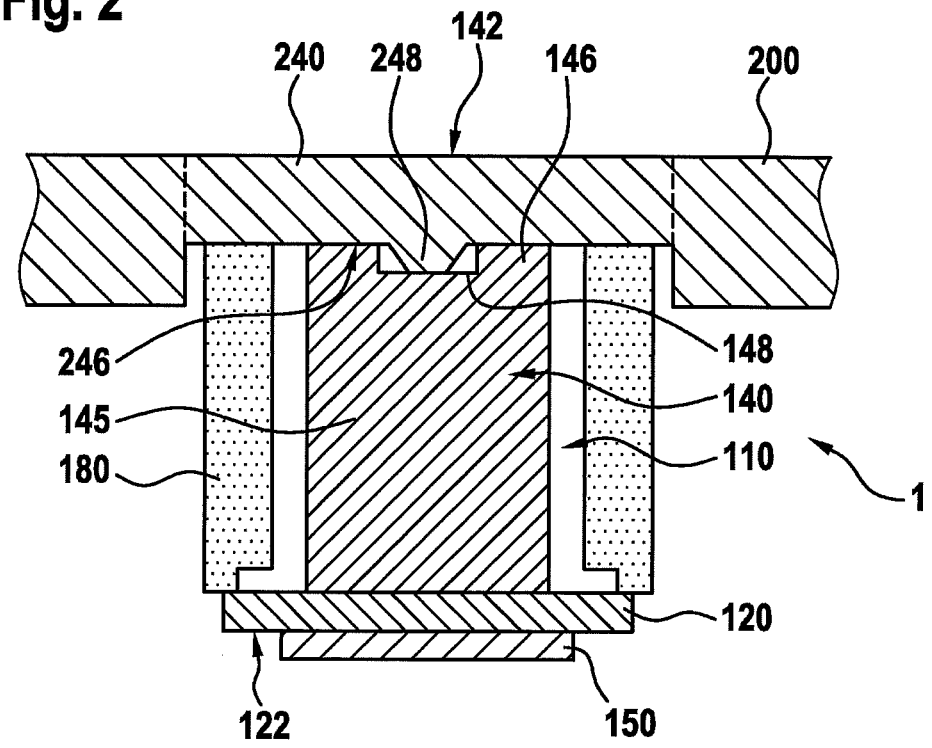
FIG. 2 shows an electroacoustic transducer according to a second embodiment of the present invention.

FIG. 2 shows a second exemplary embodiment of an electroacoustic transducer 1 schematically in a longitudinal section. The fundamental composition and the function of electroacoustic transducer 1 correspond to the transducer shown in FIG. 1. Identical elements are denoted by the same reference numerals. Contrary to the electroacoustic transducer shown in FIG. 1, piezoelectric element 150 is designed to be smaller than diaphragm 120 in this exemplary embodiment. Piezoelectric element 150 is centrically attached to the bottom side of diaphragm 120. Diaphragm 120 and rod-shaped element 145 are designed in one piece. Electroacoustic transducer 1 shown in FIG. 2 additionally includes means 148, 248 as mounting aids of the system made up of rod-shaped element 145 and plate 240. For this purpose, a recess 148 is formed centrally on end face 146 of rod-shaped element 145 as a mounting aid element. In complementary fashion, plate 240 has an elevation 248 on its surface 246 facing end face 146. When rod-shaped element 145 and plate 240 are joined, elevation 248 engages in recess 148. In this way, it is ensured that the rod-shaped element is correctly positioned relative to plate 240. Deviations in the positioning may result in undesirable deviations in the radiation pattern and/or the resonance frequency of electroacoustic transducer 1; in particular, non-centrical force introductions into the involved structures may occur, whereby undesirable so-called "spurious oscillations" may be created in other coordinate directions. These deviations and undesirable effects are avoided due to the mounting aid elements.

Figure 3:
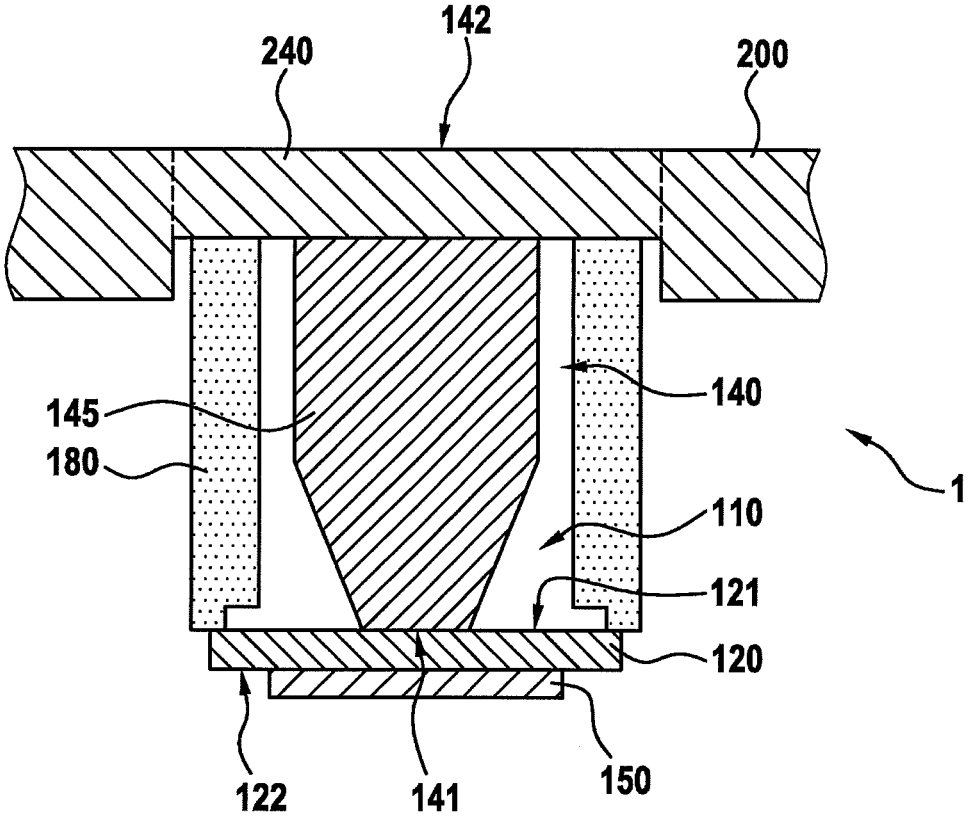
FIG. 3 shows an electroacoustic transducer according to a third embodiment of the present invention.

FIG. 3 shows a third exemplary embodiment of an electroacoustic transducer 1 schematically in a longitudinal section. The fundamental composition and the function of electroacoustic transducer 1 correspond to the transducer shown in FIG. 1. Identical elements are denoted by the same reference numerals. Contrary to the electroacoustic transducer shown in FIG. 1, in this exemplary embodiment rod-shaped element 145 is designed in such a way that it has a decreasing cross-sectional area in the direction of first surface 141 connected to diaphragm 120. In other words, rod-shaped element 145 has a tapering design in the direction of its end connected to diaphragm 120. The resulting reduced connecting surface between rod-shaped element 145 and diaphragm 120 causes oscillations of the diaphragm—in particular the flexural oscillations—to be impeded only little by the rod-shaped element. It is additionally or alternatively conceivable to also design the end of the rod-shaped element facing plate 240 in a tapering manner. In addition or as an alternative, it may be provided that one end face or both of end faces 141 and 146 of rod-shaped element 145 has/have a central recess, which causes the particular connecting surface between rod-shaped element 145 and diaphragm 120 or plate 140 to have an annular design. In this way, a further reduction in impediment of oscillations of diaphragm 120 or of plate 240 is achieved.

What is claimed is:

1. An electroacoustic transducer for emitting sound waves to an external environment and sensing sound waves received from the external environment, comprising:

a housing;

an oscillating structure including a piezoelectric element, a diaphragm above the piezoelectric element, and an acoustic transmitter above the diaphragm, so that the diaphragm is at a first side of the acoustic transmitter and the external environment is at a second side of the acoustic transmitter that is opposite the first side of the acoustic transmitter; and an electrical connecting device contacting an electrode of the piezoelectric element, wherein:

the diaphragm is connected to the piezoelectric element;

the acoustic transmitter includes a first surface and a second surface in parallel to the first surface;

the first surface of the acoustic transmitter is coupled to the diaphragm;

the diaphragm is a bending transducer;

the acoustic transmitter is a thickness mode transducer;

the electroacoustic transducer is configured to perform the emission by the electrical connecting device applying a voltage to the piezoelectric element, the piezoelectric element responding to the applied voltage by causing the diaphragm to oscillate with a first flexural oscillation, the first flexural oscillation of the diaphragm exciting a component of the acoustic transmitter to oscillate with a thickness mode oscillation, by which thickness mode oscillation the acoustic transmitter emits a sound wave to the external environment; and for the sensing, the acoustic transmitter is configured to be excited by a sound wave received from the external environment, by which excitation the acoustic transmitter is configured to excite the diaphragm to oscillate with a second flexural oscillation that generates a voltage signal at the piezoelectric element, which the electrical connecting device is configured to tap and evaluate to characterize the sound wave received from the external environment.

2. The electroacoustic transducer as recited in claim 1, wherein:

the first surface of the acoustic transmitter is coupled to a first surface of the diaphragm, and a second surface of the diaphragm is connected to the piezoelectric element.

3. The electroacoustic transducer as recited in claim 2, wherein the diaphragm is bonded to the piezoelectric element.

4. The electroacoustic transducer as recited in claim 1, wherein the acoustic transmitter includes a rod-shaped element and a plate.

5. The electroacoustic transducer as recited in claim 4, wherein:

the plate is part of a lining element, and the housing is joined to an inside surface of the lining element in such a way that the electroacoustic transducer is not visible from the outside.

6. The electroacoustic transducer as recited in claim 5, wherein the lining element is a bumper.

7. The electroacoustic transducer as recited in claim 5, wherein the plate has a lower material thickness compared to a surrounding area of the lining element.

8. The electroacoustic transducer as recited in claim 7, wherein a ratio between a diameter of the plate to a thickness of the plate is approximately 10/1.

9. The electroacoustic transducer as recited in claim 4, wherein:

the rod-shaped element is held on the housing with the aid of a bearing structure that is situated at a height of the rod-shaped element which corresponds to a node of a resonance oscillation of the oscillating structure.

10. The electroacoustic transducer as recited in claim 4, wherein the rod-shaped element has a decreasing cross-sectional area at least one of in a direction of the first surface connected to the diaphragm and in a direction of an end face connected to the plate.

11. The electroacoustic transducer as recited in claim 4, wherein:

the rod-shaped element has at least one mounting aid element that includes one of a recess and an elevation on an end face facing the plate, the plate includes at least one complementary mounting aid element on a surface facing the end face, and a centrical positioning of the rod-shaped element and of the plate is achieved as a result of an engagement of the mounting aid element and the complementary aid element in each other.

12. The electroacoustic transducer as recited in claim 4, wherein the rod-shaped element extends longitudinally from the diaphragm to the plate, with a first edge of the rod being connected to a top surface of the diaphragm and a second edge of the rod being connected to a bottom surface of the plate, the diaphragm, rod, and plate thereby forming an 'I' shape in cross-section.

13. The electroacoustic transducer as recited in claim 4, wherein:

an upper surface of the diaphragm is attached to an underside of the housing;

the rod-shaped element extends longitudinally, from the upper surface of the diaphragm to an underside of the plate, within an interior space of the housing; and an underside of the plate is above a top surface of the housing.

14. The electroacoustic transducer as recited in claim 13, wherein a width or diameter of the interior space widens at a bottom end of the housing.

15. The electroacoustic transducer as recited in claim 4, wherein the electroacoustic transducer is configured so that:

in the case of the emission, the first flexural oscillation excites the rod-shaped element, thereby causing the plate to emit the emitted sound wave to the external environment; and the sound wave received from the external environment excites the plate, the excitation of the plate exciting the rod-shaped element and the excitation of the rod-shaped element exciting the diaphragm to oscillate with the second flexural oscillation.

16. The electroacoustic transducer as recited in claim 15, wherein a top surface of the plate is exposed to the external environment, and the sound wave received from the external environment impinges upon the plate to cause the excitation of the plate.

17. The electroacoustic transducer as recited in claim 1, wherein the diaphragm is attached to the housing with the aid of a bearing structure.

18. The electroacoustic transducer as recited in claim 1, wherein:

the piezoelectric element includes a design that is one of quadrangular, circular, annular, elliptic, and arbitrary, and the piezoelectric element is bonded to the diaphragm across a full surface.

19. The electroacoustic transducer as recited in claim 1, wherein a length of the electroacoustic transducer is equal to approximately half of a wavelength of a resonance oscillation of the oscillating structure.

* * * * *